US005975400A

United States Patent [19]

Yang

[11] Patent Number: 5,975,400

[45] Date of Patent: Nov. 2, 1999

[54] FOLLOW BLOCK STRUCTURE OF A MACHINE

[75] Inventor: Brad Yang, Taichung Hsien, Taiwan

[73] Assignee: Testo Industry Corp., Ta Li

[21] Appl. No.: 09/088,055

[22] Filed: Jun. 1, 1998

[51] Int. Cl.[6] ..... B25C 5/02

[52] U.S. Cl. ..... 227/120; 227/134

[58] Field of Search ..... 227/120, 132, 227/134, 119, 156

[56] References Cited

U.S. PATENT DOCUMENTS

| | | | |
|---|---|---|---|
| 5,163,596 | 11/1992 | Ravoo et al. | 227/120 |
| 5,335,800 | 8/1994 | Liu | 227/120 |
| 5,505,362 | 4/1996 | Marks | 227/120 |
| 5,655,697 | 8/1997 | Yeh | 227/120 |
| 5,673,838 | 10/1997 | Reitze | 227/120 |

*Primary Examiner*—Scott A. Smith
*Attorney, Agent, or Firm*—Donald C. Casey, Esq

[57] ABSTRACT

A follow block structure of a magazine for stapling guns adapted for use in a fastener feed structure of a stapling gun, the magazine including a slide groove along which a follow block may slidably displace. The follow block includes a pull tab extending from one side thereof, a recess at a central portion thereof for mounting a slide element. The slide element is insertably fitted to the follow block to aid the follow block in slidable displacement along the slide groove to push fasteners forwardly. The slide element is made of engineering plastics so that there is a relatively small friction coefficient when it slides along the slide groove which is made of aluminum alloy. The slide element has good wear resistance and can ensure the smooth displacement of the follow block. Besides, the slide element can be easily and conveniently replaced when worn so that maintenance cost is reduced.

1 Claim, 3 Drawing Sheets

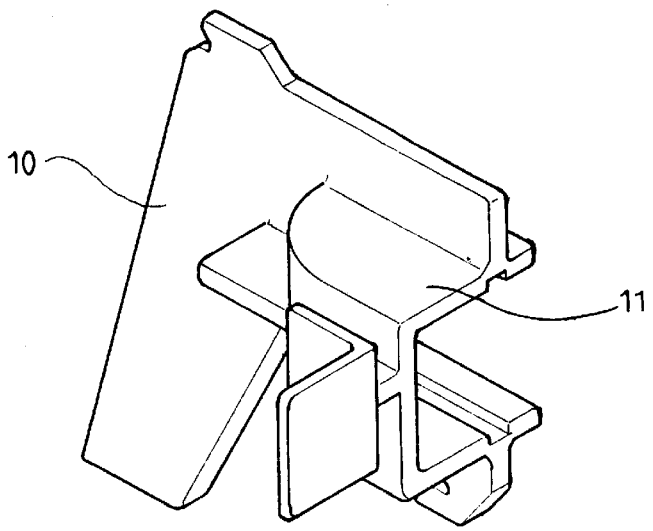
FIG. 1(A) PIROR ART
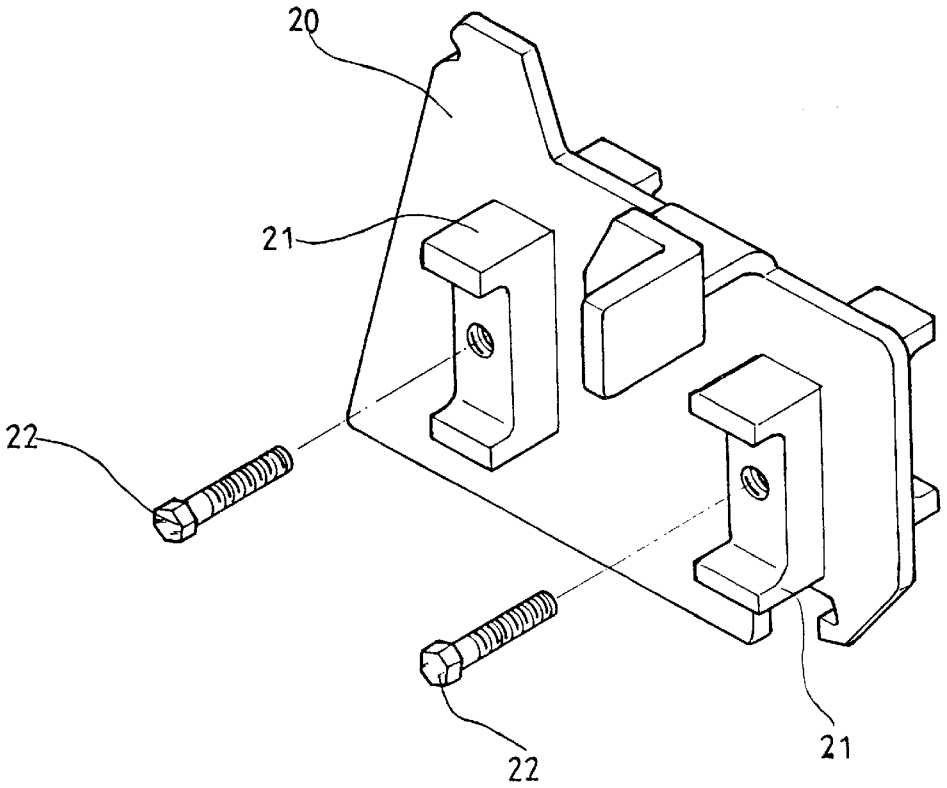
FIG. 1(B) PIROR ART

FOLLOW BLOCK STRUCTURE OF A MACHINE

BACKGROUND OF THE INVENTION (a) Field of the Invention:

The present invention relates generally to a follow block structure of a magazine for stapling guns, and more particularly to a follow block structure including a slide element that has good wear resistance and is easily replaceable to simply the manufacturing process and reduce the number of necessary components.

(b) Description of the Prior Art:

FIGS. 1A and 1B show two different types of conventional follow block structures for stapling guns. In FIG. 1A, the follow block structure is an integrally formed iron product of a follow block 10 and a slide element 11. When such follow block structure is installed in a slide groove of the stapling gun and rubs against the aluminum alloy housing of the stapling gun, the housing will be easily damaged worn since the friction coefficient of the contact surface is large. Once the slide element 11 has been worn out, it cannot stay in its proper position to push the fasteners, and the entire follow block structure has to be discarded. It is a waste of resources to discard the entire follow block structure just because the slide element is damaged.

The follow block structure in FIG. 1B includes a plastic slide element 21 locked to an iron follow block 20 by bolts 22. Although the friction between the plastic slide element 21 and the housing is reduced, assembly is quite troublesome. Besides, the components thereof are arranged in a scattered manner and secured by bolts. It is therefore desirable to have an improved follow block structure that eliminates the drawbacks with the prior art.

SUMMARY OF THE INVENTION

A primary object of the present invention is to provide a follow block structure of a magazine for stapling guns, that has an easily detachable slide element made of engineering plastics to reduce friction between the follow block structure and a housing of the magazine. The slide element has good wear resistance and inexpensive. Besides, it may be easily replaced when worn to save maintenance costs. According to the present invention, the slide element has upper and lower tracks that may insertably fit into a recess of a follow block. The follow block structure is installed in the magazine, and the slide element may slidably displace in the magazine. The slide element is easy and convenient to install and detached so that maintenance cost is reduced. Besides, it ensures smooth displacement of the follow block in the magazine.

BRIEF DESCRIPTION OF THE DRAWINGS

The foregoing and other features and advantages of the present invention will be more clearly understood from the following detailed description and the accompanying drawings, in which, FIGS. 1A and 1B are schematic views of follow block structures of the prior art;

DETAILED DESCRIPTION OF THE PREFERRED EMBODIMENT

Figure 2:
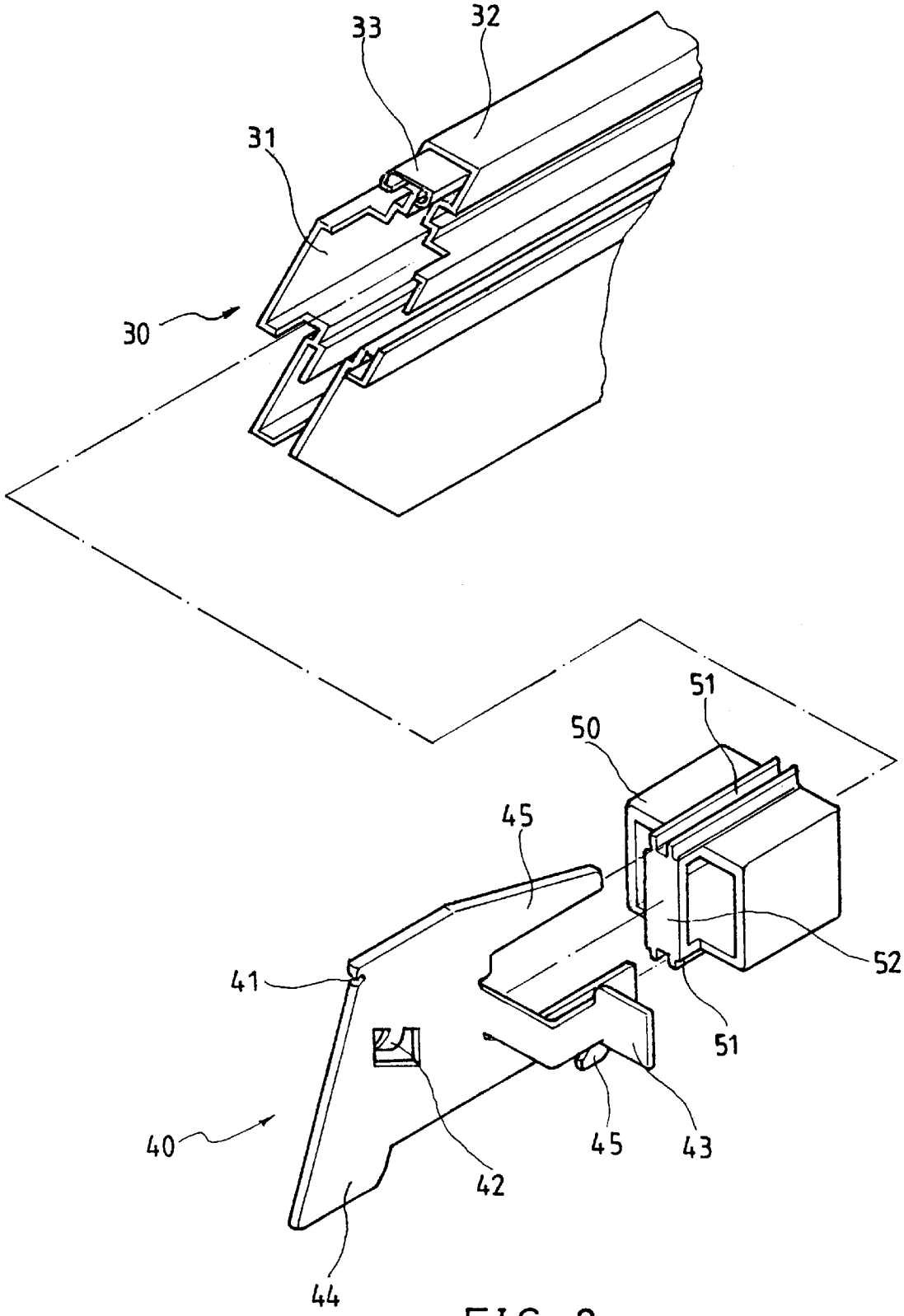
FIG. 2 is a schematic view illustrating the structure of the present invention.

As shown in FIG. 2, the present invention essentially comprises a magazine 30, a follow block 40, and a slide element 50. The magazine 30 is internally provided with a slide groove 31 along which the follow block 40 and the slide element 50 may slidably displace. An upper portion of the magazine forms a groove track 32 that is wide at the top, narrow at the bottom. The groove track 32 is sized to accommodate fasteners and a fastener guide strip 33.

The follow block 40 is a metal plate structure. A front end of the follow block 40 that is in contact with the fasteners is configured to be an inclined surface. An upper end of the follow block 40 has a notch 41 that may precisely urge against and position the fasteners properly. A spring hook 42 is provided at substantially the center of the follow block 40, and a pull tab 43 extends from one side of the follow block 40 to facilitate the pulling of the follow block 40 for the loading of fasteners. A guide portion 44 extends from a lower side of the follow block 40 to ensure the smooth displacement of the follow block 40 along the slide groove 31. Two wing-shaped plates 45 extend from a rear end of the follow block 40 and are sized to just fit into tracks 51 of the slide element 50 to be held fast therein.

The slide element 50 is made of engineering plastics and is configured to be a frame structure. Upper and lower ends of the slide element 50 are provided with the above-mentioned tracks 51, whereby the slide element 50 may be quickly assembled to or disengaged from the wing-shaped plates 45 of the follow block 40 A positioning plate 52 is provide ween the tracks 51 to achieve a positioning effect when the slide element 51 is assembled to the follow block 40.

Figure 3:
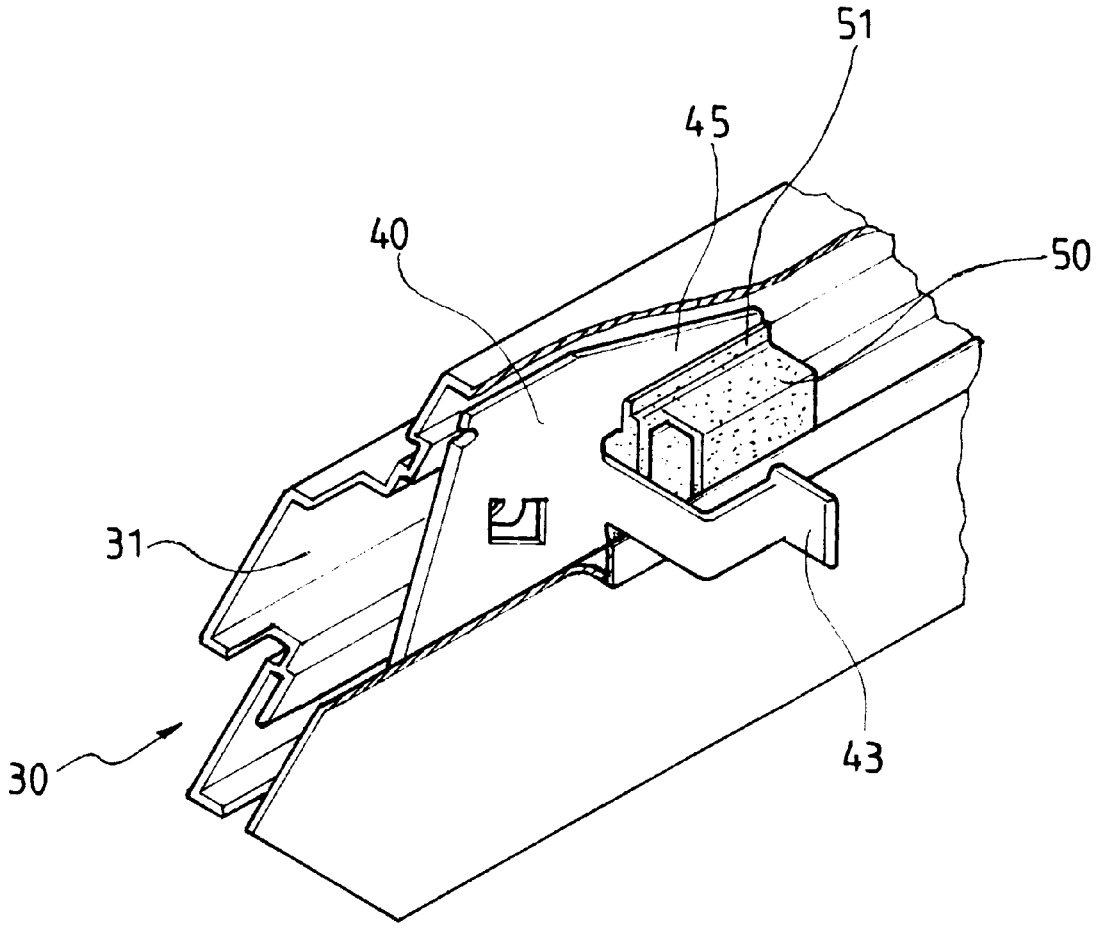
FIG. 3 is a schematic view illustrating operation of the present invention.

In assembly, the tracks 51 of the slide element 50 are aligned with the wing-shaped plates 45 at the rear end of the follow block 40 with the positioning plate 52 urging against the follow block 40. After coupling the slide element 50 to the follow block 40, an integral slide structure is accomplished. The integral slide structure thus formed is installed in the slide groove 41 of the magazine 30, and the advancement of retrieval of the follow block 40 is controlled by pulling the pull tab 43, as shown in FIG. 3. After installation, the major slide contact surface of the slide structure is located at the outer edge of the slide element 50. Since the slide element 50 is made of engineering plastics, it can resist wear and reduce friction coefficient, thereby effectively achieving the object of slowing down wear of components, prolonging the service life of the slide structure, ensuring smooth displacement of the follow block 40, and avoiding collision or jamming of metal components. In addition, since the slide element 50 is coupled to the follow block 40 by means of the tracks 51 that engage the wing-shaped plates 45, disengagement thereof is very simple. Replacement of the slide element 50 when worn out is also very easy and quick. Besides, the slide element 50 is simple in construction and inexpensive to manufacture. It can therefore be appreciated that the present invention provides vast improvements over the prior art in terms of cost, production, and maintenance.

In summary, the present invention provides a separate slide element of engineering plastics to easily couple to the follow block inserted into the magazine at where wear will generally occur. Wear of components is therefore reduced. Besides, it is only necessary to replace the slide element during maintenance and there is no need to dispose of the entire follow plate structure. Maintenance is sped up and simplified since the slide element can be easily detached from the follow block.

Although the present invention has been illustrated and described with reference to the preferred embodiment thereof, it should be understood that it is in no way limited to the details of such embodiment but is capable of numerous modifications within the scope of the appended claims.

What is claimed is:

1. A follow block structure of a magazine, comprising:

a follow block, which is a metal plate and includes a front end configured to be an inclined surface adapted to abut against fasteners, a notch at an upper end adapted to urge against fasteners to keep them in proper position, a pull tab extending from one side thereof adapted to allow a user to withdraw said follow block during loading of fasteners, a guide portion extending from a lower side thereof, and two wing-shaped plates extending from a rear end thereof, wherein said follow block has insertably provided therein a slide element made of engineering plastics and configured to be a frame structure, said slide element including tracks at upper and lower ends thereof respectively, and a positioning plate between said tracks, said tracks being coupled to said wing-shaped plates of said follow block such that said slide element may thereby be quickly assembled to or disengage from said follow block and said wing-shaped plates of said follow block may be firmly held in said tracks of said slide element, said positioning plate being provided to achieve a positioning effect when insertably coupled to said follow block.

* * * * *